US009839252B2

(12) United States Patent
Krick et al.

(10) Patent No.: US 9,839,252 B2
(45) Date of Patent: Dec. 12, 2017

(54) VISOR SYSTEM FOR A PROTECTIVE SPORT HELMET

(75) Inventors: Thierry Krick, Côteau-du-Lac (CA); David Rudd, Vaudreuil-Dorion (CA); Charles-Antoine Desrochers, Prévost (CA)

(73) Assignee: BAUER HOCKEY, LLC, Exeter, NH (US)

( * ) Notice: Subject to any disclaimer, the term of this patent is extended or adjusted under 35 U.S.C. 154(b) by 681 days.

(21) Appl. No.: 13/484,590

(22) Filed: May 31, 2012

(65) Prior Publication Data

US 2013/0318691 A1 Dec. 5, 2013

(51) Int. Cl.

| | |
|---|---|
| ***A61F 9/00*** | (2006.01) |
| ***A61F 9/02*** | (2006.01) |
| ***A42B 3/22*** | (2006.01) |

(52) U.S. Cl.

CPC ..... *A42B 3/221* (2013.01); *A42B 3/22* (2013.01)

(58) Field of Classification Search

CPC ..... A42B 3/22; A42B 3/221
USPC ..... 2/424, 15, 10, 427, 12, 429–434, 438, 2/439

See application file for complete search history.

(56) References Cited

U.S. PATENT DOCUMENTS

| | | | | |
|---|---|---|---|---|
| 4,242,757 | A * | 1/1981 | Nava | 2/10 |
| 5,373,583 | A * | 12/1994 | Birum | 2/10 |
| 5,966,738 | A * | 10/1999 | Wang Lee | 2/10 |
| 6,125,477 | A * | 10/2000 | Crippa et al. | 2/422 |
| 6,301,719 | B1 * | 10/2001 | Goodhand et al. | 2/422 |
| 6,389,606 | B1 * | 5/2002 | Galet et al. | 2/410 |
| 6,851,129 | B2 * | 2/2005 | Gafforio et al. | 2/424 |
| 7,546,645 | B2 * | 6/2009 | Goodhand et al. | 2/424 |
| 2010/0154093 | A1 * | 6/2010 | Provost et al. | 2/10 |

* cited by examiner

*Primary Examiner* — Katharine Gracz

(57) ABSTRACT

A visor system for a protective sport helmet wearable on a head of a user is provided. The visor system comprises a visor for protecting at least part of a face of the user. The visor is transparent and comprises left and right connectors. The visor system also comprises left and right visor supports for supporting the visor on left and right sides of the protective sport helmet. The left and right connectors of the visor are toollessly connectable to and toollessly disconnectable from the left and right visor supports to allow the user to toollessly connect the visor to the left and right visor supports and toollessly disconnect the visor from the left and right visor supports. The visor system may be configured to define an open gap from a top edge of the visor to the outer shell.

29 Claims, 12 Drawing Sheets

VISOR SYSTEM FOR A PROTECTIVE SPORT HELMET

FIELD OF THE INVENTION

The invention relates generally to protective sport helmets and, more particularly, to visors for protective sport helmets.

BACKGROUND

Protective sport helmets are worn in various sports for protection against head injuries. Typically, a protective sport helmet comprises a rigid outer shell to withstand impacts and inner padding disposed within the outer shell to absorb energy when the helmet is impacted. In some cases, the helmet may be provided with a visor for facial protection.

For example, a hockey player normally wears a hockey helmet to protect his/her head against impacts, such as when the helmet hits a board or an ice or other skating surface of a hockey rink or is struck by a puck or a hockey stick. The hockey helmet may be provided with a visor to protect at least part of the player's face against such impacts. In some cases, the visor may be fastened to the helmet's outer shell by fasteners (e.g., screws) that require using a tool (e.g., a screwdriver) to attach the visor to or detach the visor from the outer shell. This may be inconvenient for visor replacement and/or for changing between use of the helmet with the visor and use of the helmet without the visor. In other cases, a visor-supporting device may be fastened to the helmet's outer shell by fasteners and allow the visor to be quickly attached to and detached from the visor-supporting device without using any tool. While this facilitates mounting and removal of the visor, the visor-supporting device is typically bulky, increases the helmet's weight, may be unappealing in appearance, and may detrimentally affect the player's vision (e.g., when the player's head is down and his/her eyes are looking up) and/or the helmet's ventilation (e.g., increasing a potential for fogging of the visor).

Similar issues with visors may be encountered in other types of protective sport helmets used in other sports (e.g., skiing, lacrosse, motorcycling, etc.).

For these and other reasons, there is a need for improvements directed to visors for protective sport helmets.

SUMMARY OF THE INVENTION

According to an aspect of the invention, there is provided a visor system for a protective sport helmet wearable on a head of a user. The protective sport helmet comprises a front for facing a front region of the head, a back for facing a back region of the head, a left side for facing a left side region of the head, and a right side for facing a right side region of the head. The protective sport helmet comprises an outer shell and inner padding disposed within the outer shell. The visor system comprises a visor for protecting at least part of a face of the user. The visor is transparent to allow the user to see through the visor. The visor comprises a top edge, a bottom edge, a left connector, and a right connector. The visor system comprises a left visor support for supporting the visor on the left side of the protective sport helmet and a right visor support for supporting the visor on the right side of the protective sport helmet. The left connector of the visor is toollessly connectable to and toollessly disconnectable from the left visor support and the right connector of the visor is toollessly connectable to and toollessly disconnectable from the right visor support to allow the user to toollessly connect the visor to the left visor support and the right visor support and toollessly disconnect the visor from the left visor support and the right visor support. The visor system is configured to define an open gap from the top edge of the visor to the outer shell when the left visor support and the right visor support are supporting the visor on the left side of the protective sport helmet and the right side of the protective sport helmet.

According to another aspect of the invention, there is provided a visor system for a protective sport helmet wearable on a head of a user. The protective sport helmet comprises a front for facing a front region of the head, a back for facing a back region of the head, a left side for facing a left side region of the head, and a right side for facing a right side region of the head. The protective sport helmet comprises an outer shell and inner padding disposed within the outer shell. The visor system comprises a visor for protecting at least part of a face of the user. The visor is transparent to allow the user to see through the visor. The visor comprises a top edge, a bottom edge, a left connector, and a right connector. The visor system comprises a left visor support for supporting the visor on the left side of the protective sport helmet and a right visor support for supporting the visor on the right side of the protective sport helmet. The left visor support and the right visor support are separate from one another and fastenable to the outer shell. The left connector of the visor is toollessly connectable to and toollessly disconnectable from the left visor support and the right connector of the visor is toollessly connectable to and toollessly disconnectable from the right visor support to allow the user to toollessly connect the visor to the left visor support and the right visor support and toollessly disconnect the visor from the left visor support and the right visor support.

According to another aspect of the invention, there is provided a visor system for a protective sport helmet wearable on a head of a user. The protective sport helmet comprises a front for facing a front region of the head, a back for facing a back region of the head, a left side for facing a left side region of the head, and a right side for facing a right side region of the head. The protective sport helmet comprises an outer shell and inner padding disposed within the outer shell. The visor system comprises a visor for protecting at least part of a face of the user. The visor is transparent to allow the user to see through the visor. The visor comprises a top edge, a bottom edge, a left connector, and a right connector. The visor system comprises a left visor support for supporting the visor on the left side of the protective sport helmet and a right visor support for supporting the visor on the right side of the protective sport helmet. The left connector of the visor is toollessly connectable to and toollessly disconnectable from the left visor support and the right connector of the visor is toollessly connectable to and toollessly disconnectable from the right visor support to allow the user to toollessly connect the visor to the left visor support and the right visor support and toollessly disconnect the visor from the left visor support and the right visor support. The visor system is configured such that the protective sport helmet is free of structure extending from the top edge of the visor to the outer shell along at least a majority of the top edge of the visor when the left visor support and the right visor support are supporting the visor on the left side of the protective sport helmet and the right side of the protective sport helmet.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

FIGS. 1 to 7 show an example of a protective sport helmet 10 for protecting a head 11 of a user in accordance with an embodiment of the invention. In this embodiment, the helmet 10 is a hockey helmet for protecting the head 11 of the user who is a hockey player.

Figure 1:
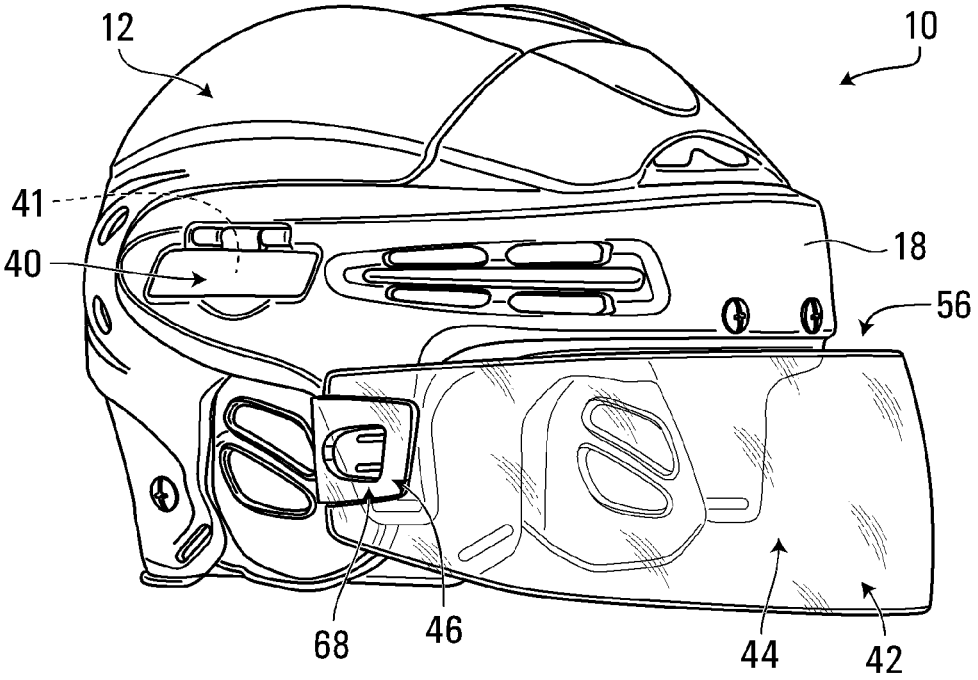
FIGS. 1 and 2 show perspective views of an example of a protective sport helmet for protecting a head of a user in which the helmet comprises a visor system in accordance with an embodiment of the invention.
Figure 2:
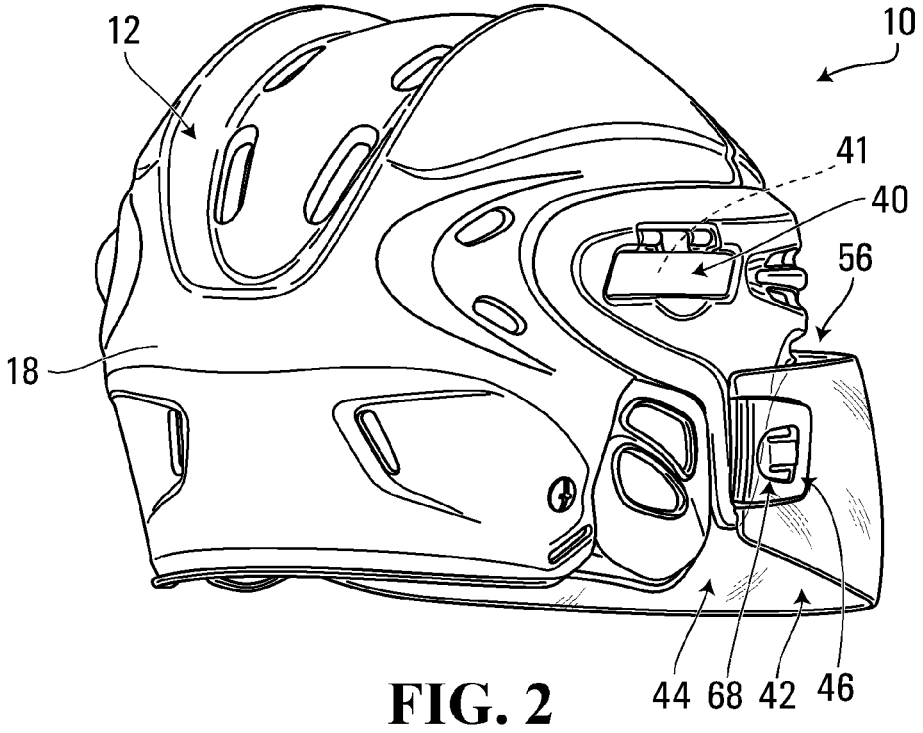
Figure 3:
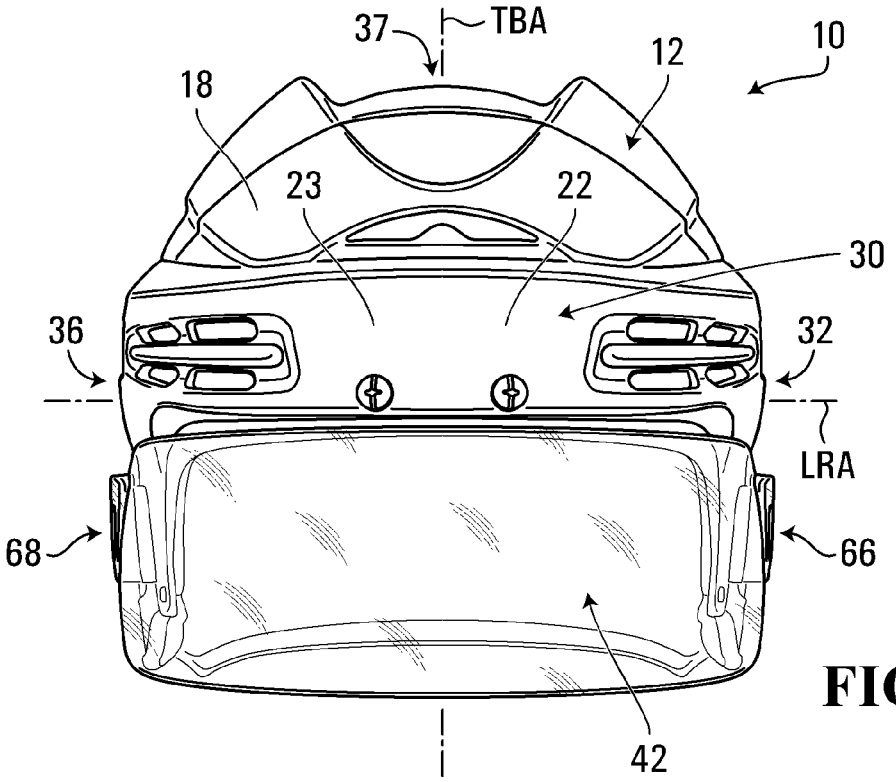
FIGS. 3 to 7 show a front elevation view, a side elevation view, a rear elevation view, a top view and a bottom view of the protective sport helmet.
Figure 4:
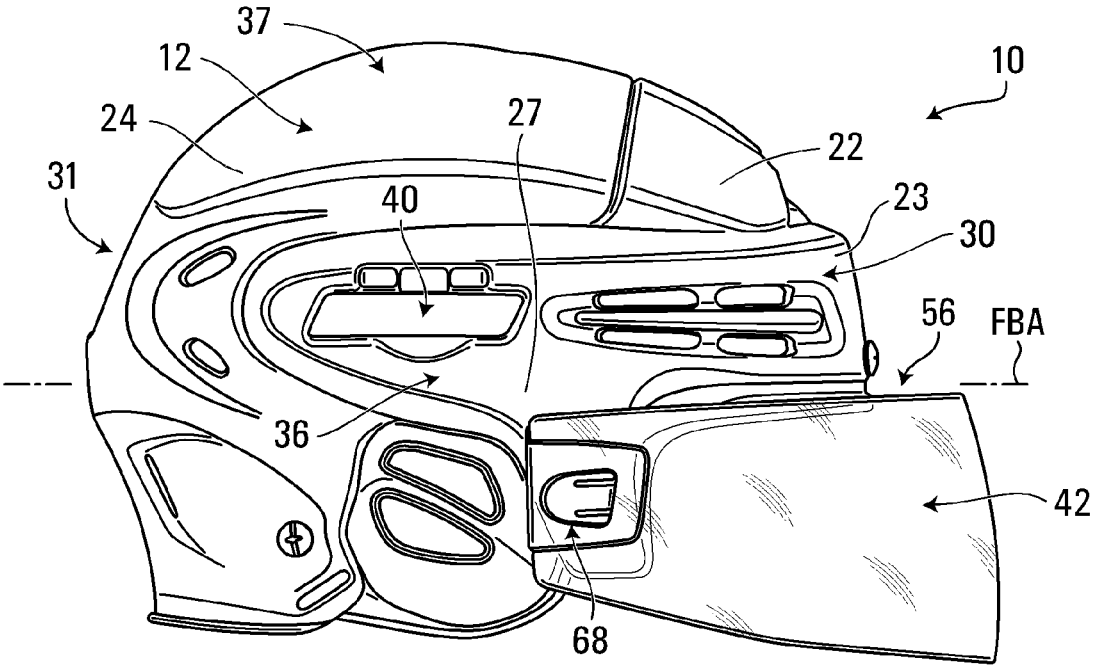
Figure 5:
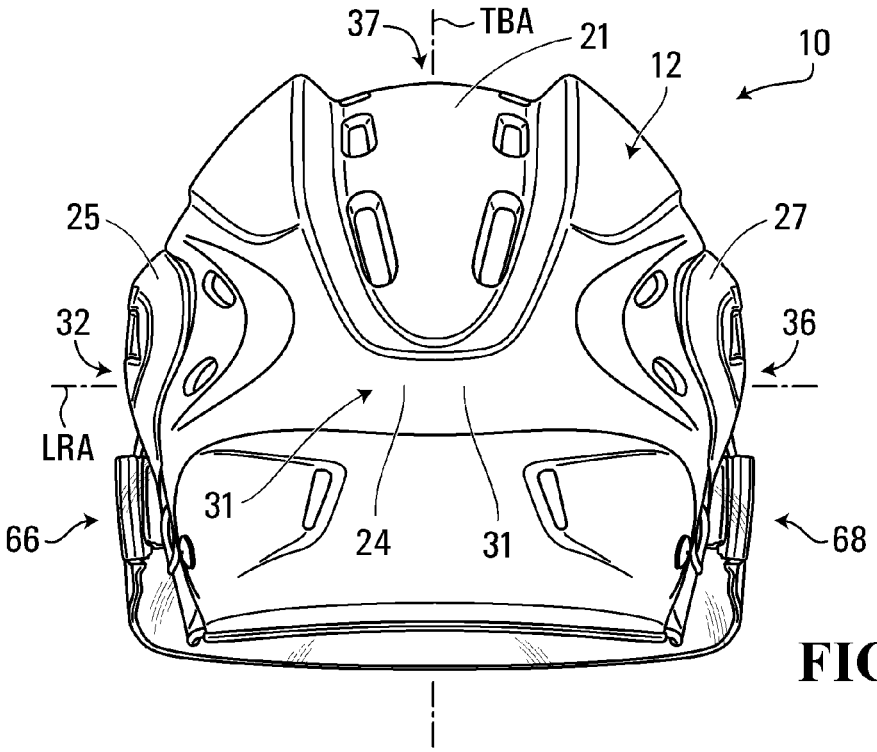
Figure 6:
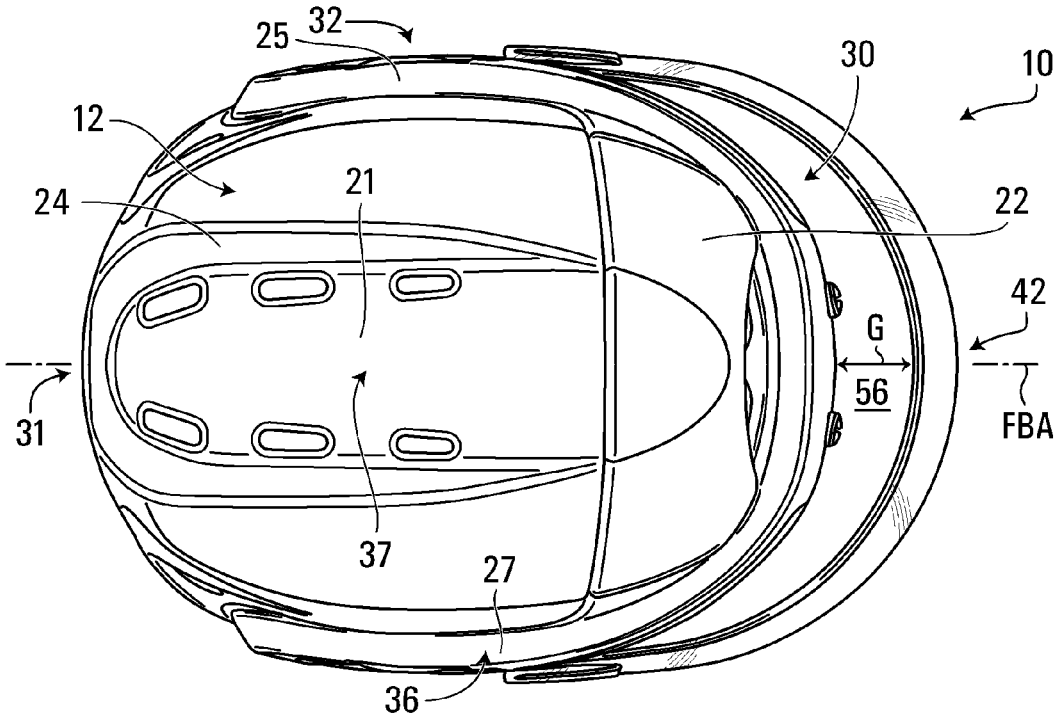
Figure 7:
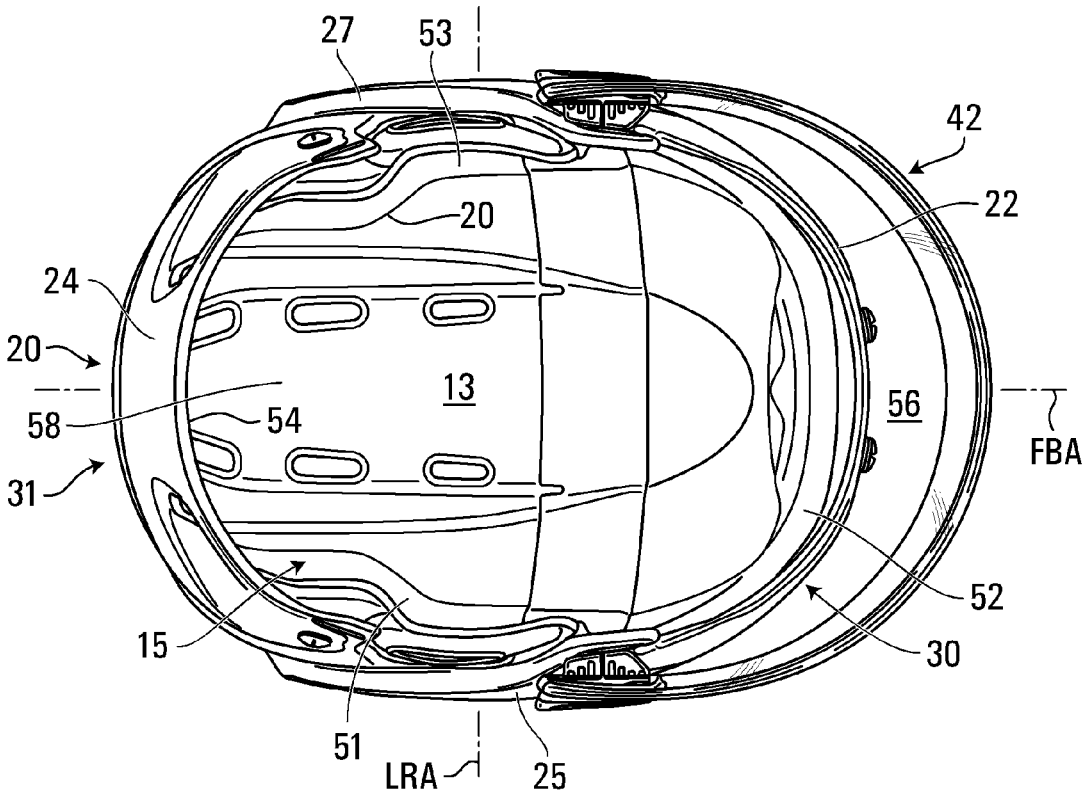
Figure 8:
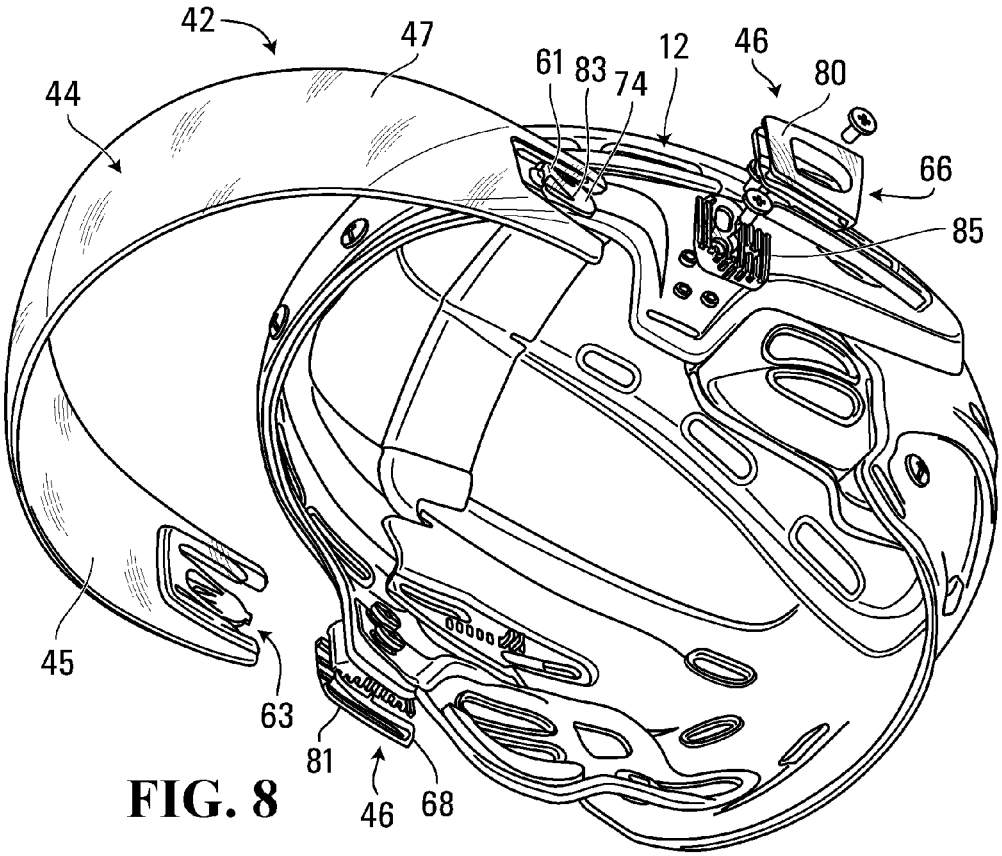
FIG. 8 shows an exploded view of the visor system and an outer shell of the helmet.
Figure 9:
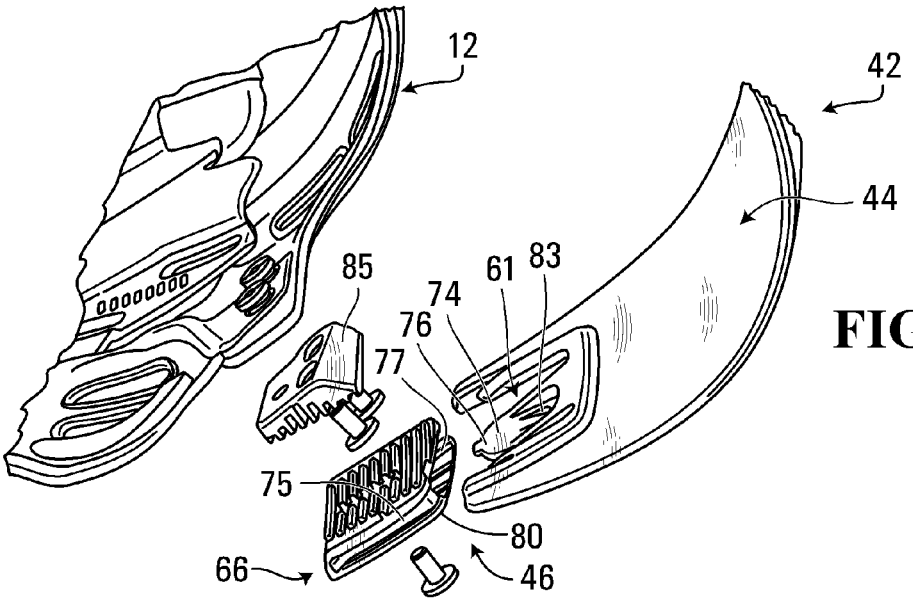
FIG. 9 shows a close-up exploded view of part of the visor system and the outer shell.
Figure 10:
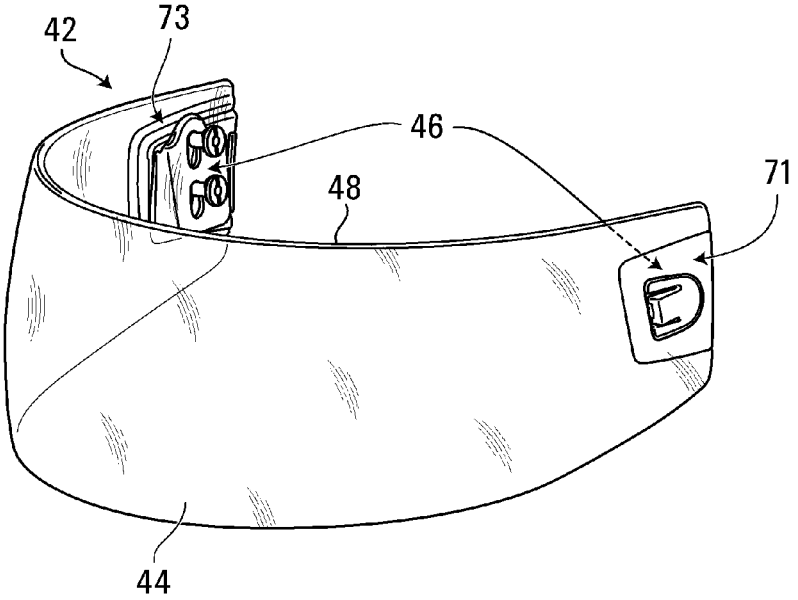
FIG. 10 shows a perspective view of a visor and a visor-supporting subsystem of the visor system.
Figure 11:
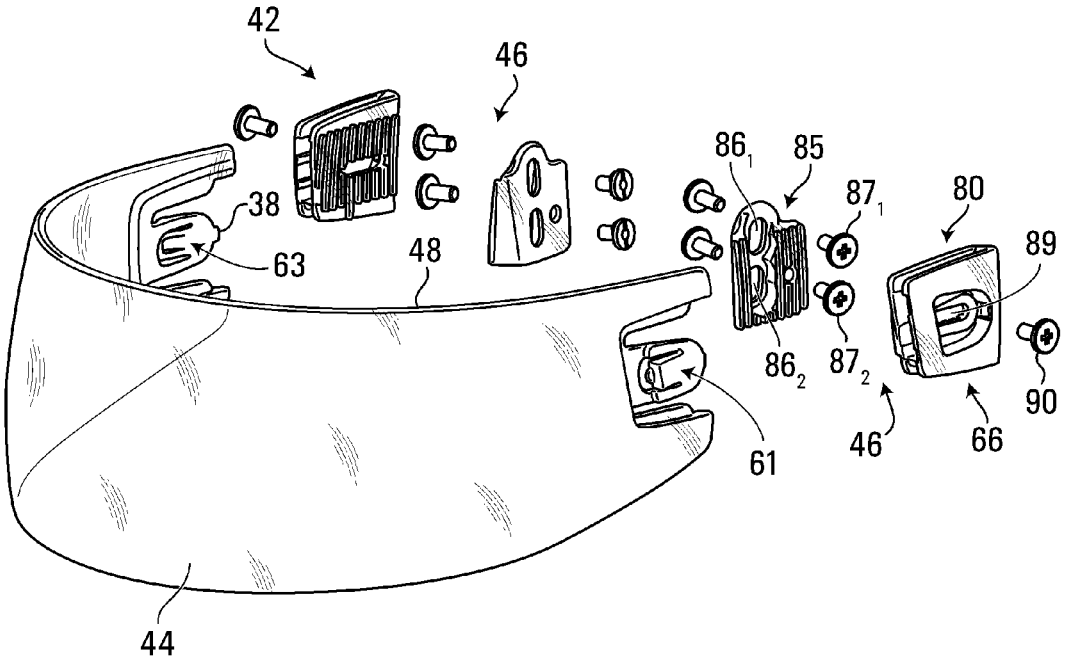
FIG. 11 shows an exploded view of the visor system.
Figure 12:
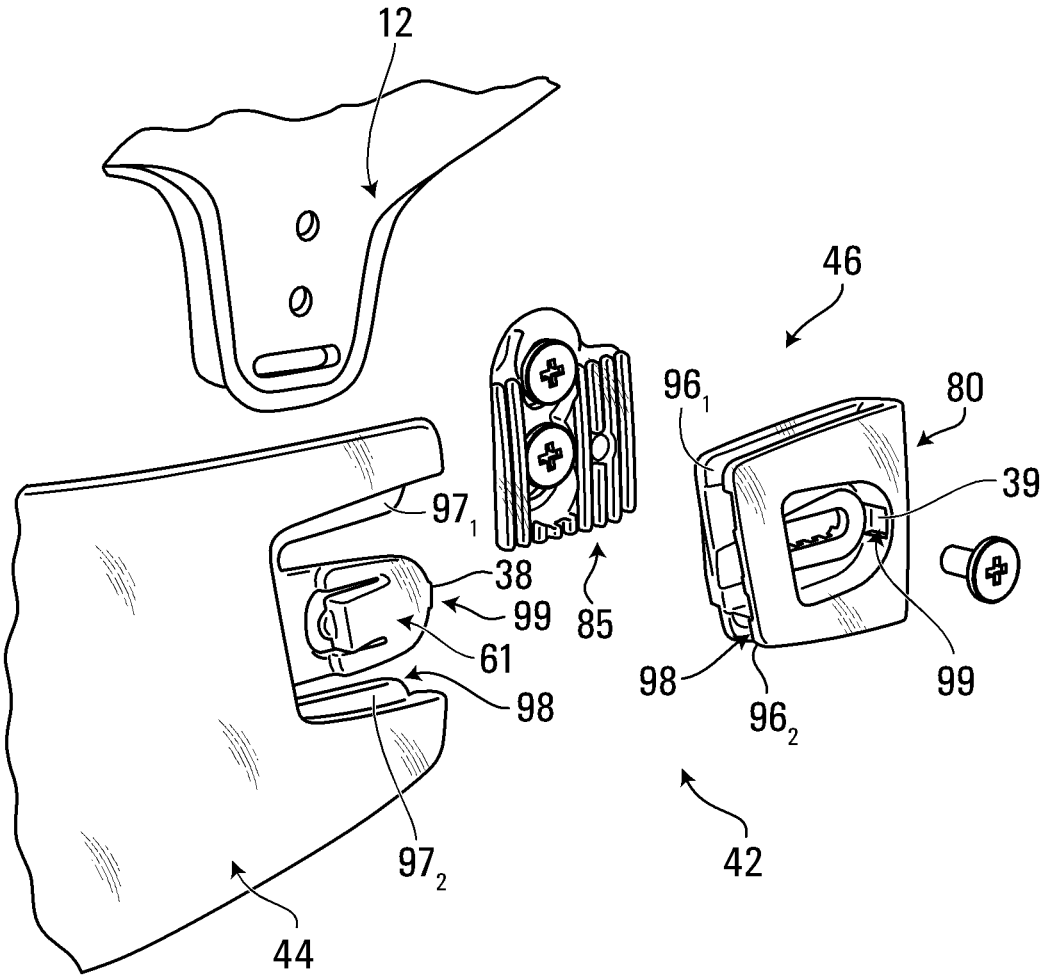
FIG. 12 shows a close-up exploded view of part of the visor system and the outer shell.
Figure 13:
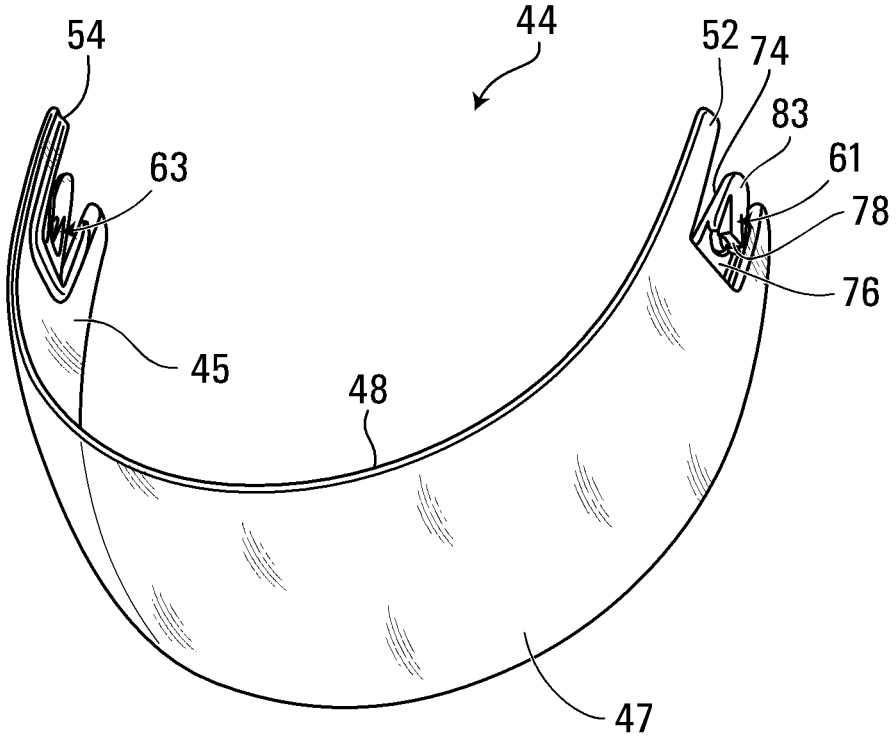
FIGS. 13 to 16 show a perspective view, a front elevation view, a top view and a cross-sectional view of the visor.
Figure 14:
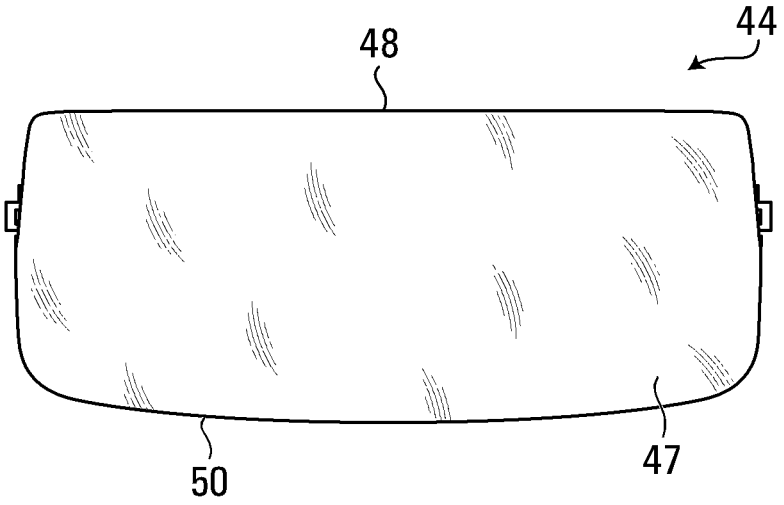
Figure 15:
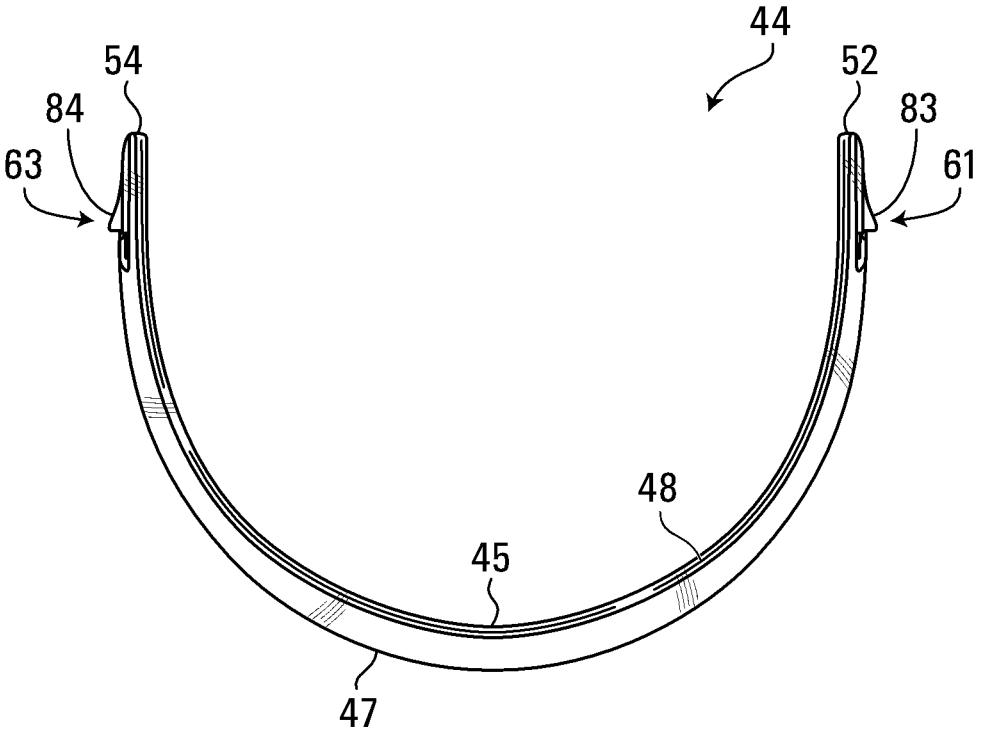
Figure 16:
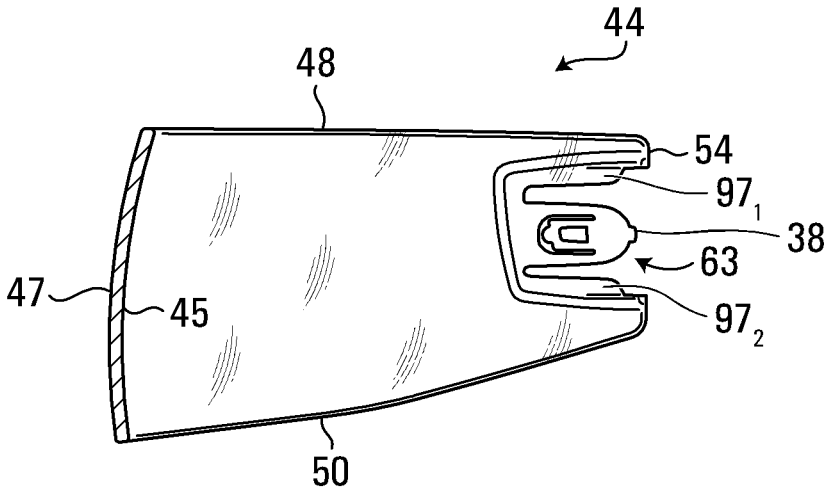
Figure 17:
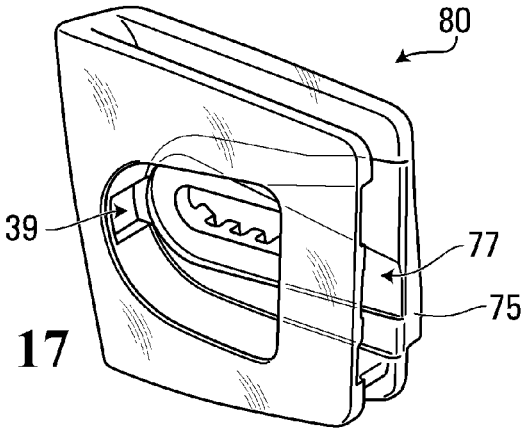
FIGS. 17 to 21 show a perspective view, a first side elevation view, a second side elevation view, a top view, and a front elevation view of a connector of a visor support of the visor-supporting subsystem.
Figure 18:
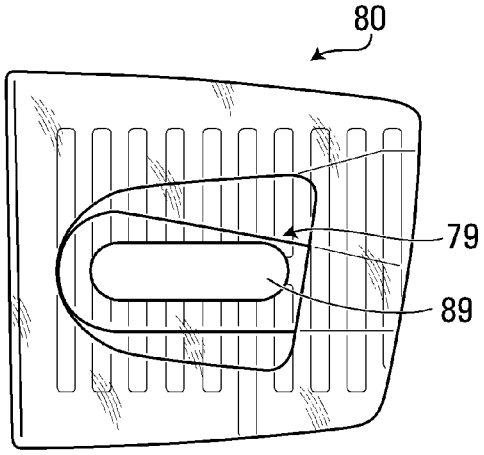
Figure 19:
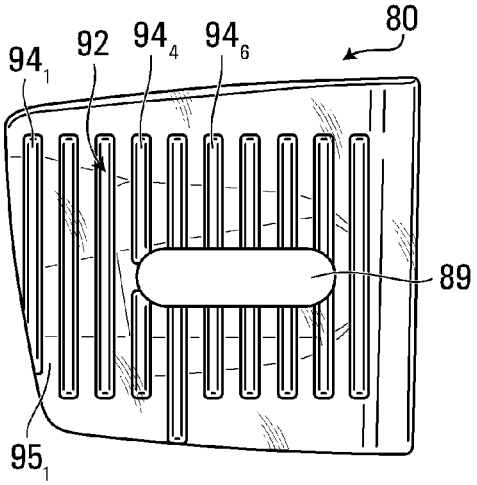
Figure 20:
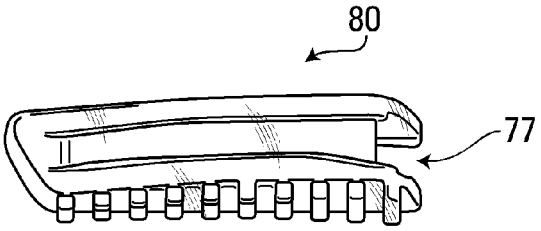
Figure 21:
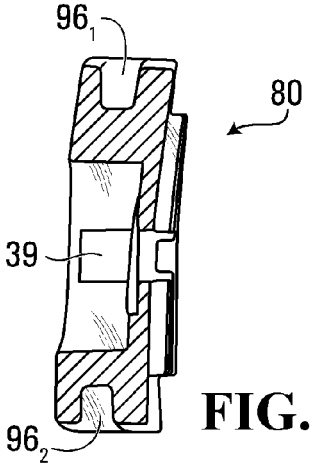
Figure 22:
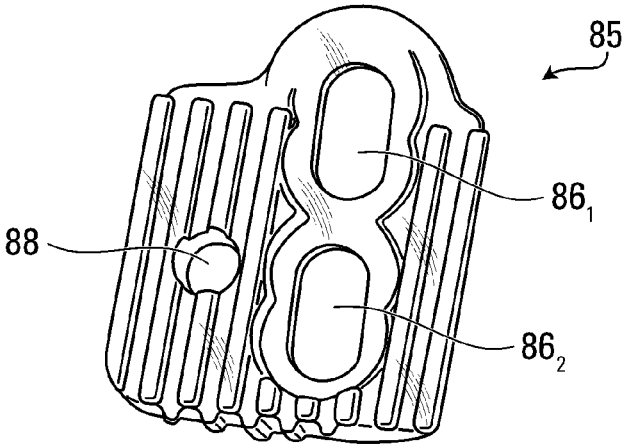
FIGS. 22 to 25 show a perspective view, a first side elevation view, a second side elevation view, and a cross-sectional view of a base of the visor support of the visor-supporting subsystem.
Figure 23:
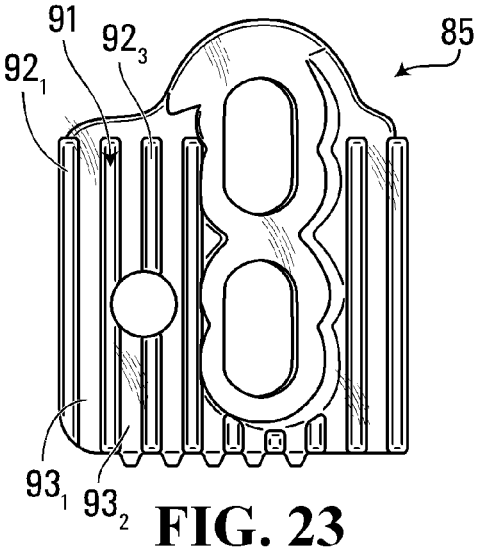
Figure 24:
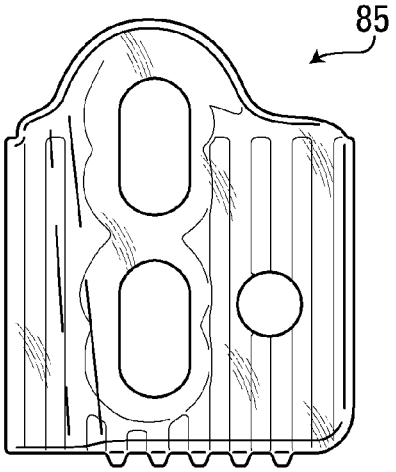
Figure 25:
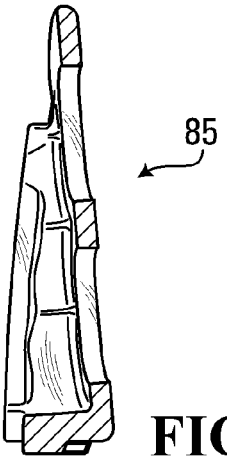
Figure 26:
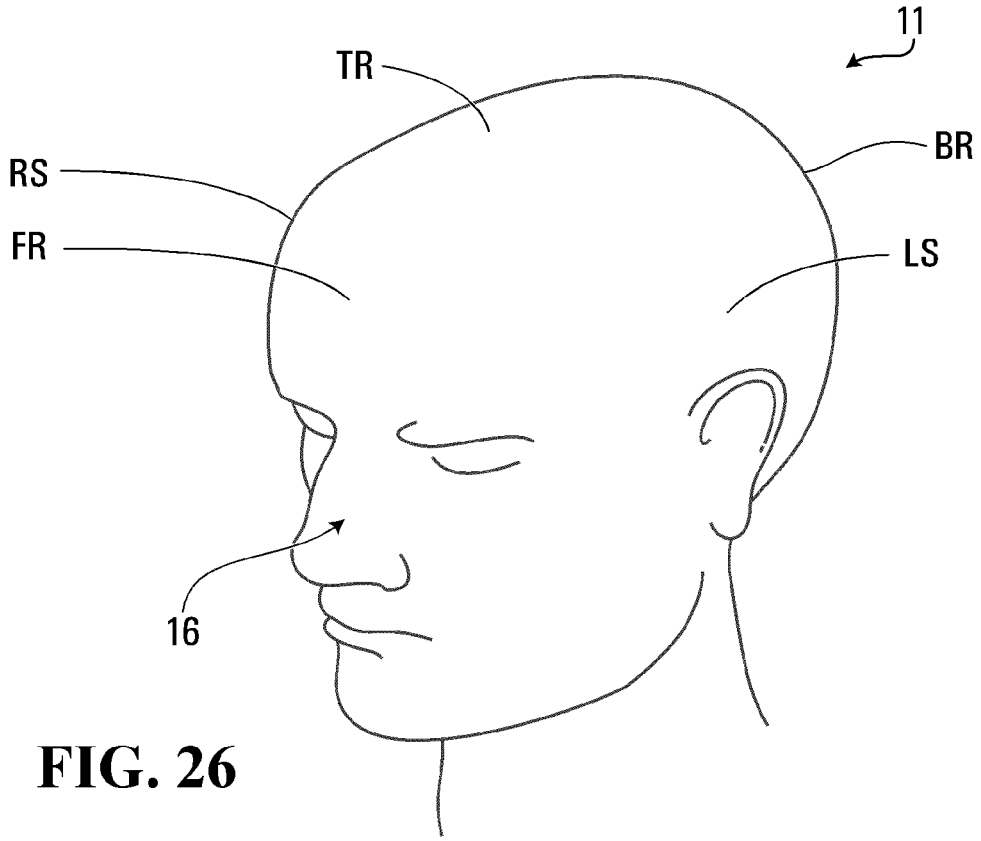
FIGS. 26 and 27 show different views of the user's head.
Figure 27:
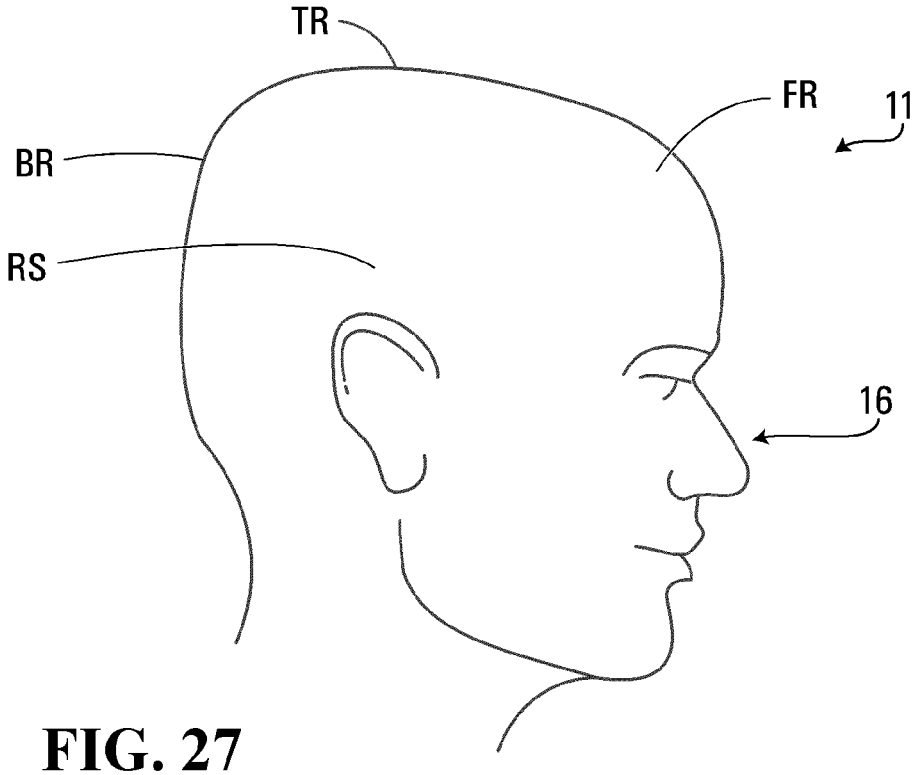

The helmet 10 is wearable on the player's head 11 to protect the player's head 11 when the helmet 10 is impacted (e.g., when the helmet 10 hits a board or an ice or other skating surface of a hockey rink or is struck by a puck or a hockey stick). The helmet 10 protects various regions of the player's head 11. As shown in FIGS. 26 and 27, the player's head 11 comprises a front region FR, left and right side regions LS, RS, a back region BR, and a top region TR. The front region FR includes a face 16 of the player and a forehead and a front upper part of the head 11 in a frontal bone area of the head 11. The left and right side regions LS, RS are located between the front region FR and the back region BR of the head 11 and respectively include left and right temples and ears of the head 11 and left and right lateral parts of the head 11 in left and right temporal bone areas of the head 11. The back region BR is opposite to the front region FR and includes a rear upper part of the head 11 and an occipital protuberance of the head 11 in a parietal bone area and occipital bone area of the head 11.

The helmet 10 comprises a front 30 for facing the front region FR of the player's head 11, a back 31 for facing the back region BR of the player's head 11, left and right sides 32, 36 for respectively facing the left and right side regions LS, RS of the player's head 11, and a top 37 for facing the top region TR of the player's head 11. The helmet 10 has an external surface 18 and an internal surface 20 that defines a cavity 13 for receiving the player's head 11 and contacts the player's head 11 when the helmet 10 is worn.

The helmet 10 comprises a visor system 42 for protecting at least part of the player's face 16. As further discussed later on, in this embodiment, the visor system 42 is configured to allow the player to manually attach and detach a visor to and from the helmet 10 without using any tool. This enables rapid and convenient visor attachment and detachment. Also, in this embodiment, the visor system 42 is relatively lightweight and airy and this may help to improve the player's vision and air circulation at the visor system 42. In addition, in this embodiment, the visor system 42 is adjustable and removable such that it can be adjusted on the helmet 10 and/or be compatible with different helmet models.

The helmet 10 has a front-back axis FBA, a left-right axis LRA, and a top-bottom axis TBA which are respectively generally parallel to a dorsoventral axis, a dextrosinistral axis, and a cephalocaudal axis of the player when the helmet 10 is worn and which respectively define a front-back direction, a left-right direction, and a top-bottom direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the left-right direction can also be referred to as a longitudinal direction and a transversal direction. As it is generally oriented along a height of the helmet 10, the top-bottom axis TBA can also be referred to as a height axis, while the top-bottom direction can also be referred to as a height direction.

The helmet 10 comprises an outer shell 12 and inner padding 15 disposed within the outer shell 12. The outer shell 12 and the inner padding 15 cooperate to withstand an impact on the helmet 10 and absorb energy from the impact in order to protect the player's head 11.

The outer shell 12 provides strength and rigidity to the hockey helmet 10. To that end, the outer shell 12 is made of rigid material. Notably, the outer shell 12 is more rigid than the inner padding 15. For example, in various embodiments, the outer shell 12 may be made of thermoplastic material such as polyethylene, polyamide (nylon), or polycarbonate, of thermosetting resin, or of any other suitable material. The outer shell 12 has an inner surface facing the inner padding 15 and an outer surface opposite the inner surface 17. The outer surface of the outer shell 12 constitutes the external surface 18 of the helmet 10.

In this embodiment, the outer shell 12 comprises a front portion 23 for facing the front region FR of the player's head 11, left and right side portions 25, 27 for facing the left and right side regions LS, RS of the player's head 11, a back portion 31 for facing the back region BR of the player's head 11, and a top portion 21 for facing the top region TR of the wearer's head 11. These portions of the outer shell 12 constitute respective parts of the front 30, the left and right sides 32, 36, the back 31, and the top 37 of the helmet 10.

More particularly, in this embodiment, the outer shell 12 comprises a front outer shell member 22 and a rear outer shell member 24 that are connected to one another. The front outer shell member 22 comprises the front portion 23 of the outer shell 12 and left and right side portions constituting respective parts of the left and right side portions 25, 27 of the outer shell 12. The rear outer shell member 24 comprises the back portion 31 of the outer shell 12, left and right side portions constituting respective parts of the left and right side portions 25, 27 of the outer shell 12, and the top portion 21 of the outer shell 12.

In this example of implementation, the helmet 10 is adjustable to adjust how it fits on the player's head 11. To that end, the helmet 10 comprises an adjustment mechanism 40 for adjusting a fit of the helmet 10 on the player's head 11. The adjustment mechanism 40 allows the fit of the helmet 10 to be adjusted by adjusting one or more internal dimensions of the cavity 13 of the helmet 10, such as a dimension of the cavity 13 in the longitudinal direction of the helmet 10 and/or a dimension of the cavity 13 in the transversal direction of the helmet 10.

More particularly, in this example of implementation, the outer shell 12 and the inner padding 15 are adjustable to adjust the fit of the helmet 10 on the player's head 11. To that end, in this case, the front outer shell member 22 and the rear outer shell member 24 are movable relative to one another to adjust the fit of the helmet 10 on the player's head 11. The adjustment mechanism 40 is connected between the front outer shell member 22 and the rear outer shell member 24 to enable adjustment of the fit of the helmet 10 by moving the outer shell members 22, 24 relative to one another. In this example, relative movement of the outer shell members 22, 24 for adjustment purposes is in the longitudinal direction of the helmet 10 such that the dimension of the cavity 13 in the longitudinal direction of the helmet 10 is adjusted.

The adjustment mechanism 40 may be implemented in any suitable way. For example, in this embodiment, the adjustment mechanism 40 comprises an actuator 41 on each of the left and right sides of the helmet 10 such that the actuator 41 can be moved by the player between a locked position, in which the actuator 41 is engaged to lock the outer shell members 22, 24 relative to one another, and a release position, in which the actuator 41 is disengaged to permit the outer shell members 22, 24 to move relative to one another so as to adjust the size of the helmet 10. Such adjustment mechanisms are well-known and will not be described further herein.

The outer shell 12 may be implemented in various other ways in other embodiments. For example, in other embodiments, the outer shell 12 may be a single-piece shell.

The inner padding 15 is disposed on the inner surface of the outer shell 12 such that, in use, it is disposed between the outer shell 12 and the player's head 11 to absorb impact energy when the helmet 10 is impacted. The inner padding 15 has an outer surface facing the outer shell 12 and an inner surface facing the player's head 11 and has a three-dimensional external configuration that generally conforms to a three-dimensional internal configuration of the outer shell 12. The inner padding 15 comprises shock-absorbing material to absorb impact energy when the helmet 10 is impacted. For example, in this embodiment, the inner padding 15 comprises polymeric cellular material. For instance, the polymeric cellular material may comprise polymeric foam such as expanded polypropylene (EPP) foam, expanded polyethylene (EPE) foam, or any other suitable polymeric foam material and/or may comprise expanded polymeric microspheres (e.g., Expancel™ microspheres commercialized by Akzo Nobel). Any other material with suitable impact energy absorption may be used for the inner padding 15 in other embodiments.

In this embodiment, the inner padding 15 comprises a front portion 52 for facing the front region FR of the player's head 11, left and right side portions 51, 53 for facing the left and right side regions LS, RS of the player's head 11, a back portion 54 for facing the back region BR of the player's head 11, and a top portion 58 for facing the top region TR of the wearer's head 11. These portions of the inner padding 15 constitute respective parts of the front 30, the left and right sides 32, 36, the back 31, and the top 37 of the helmet 10.

More particularly, in this embodiment, the inner padding 15 comprises a plurality of inner pads which are movable relative to one another and with the outer shell members 22, 24 to allow adjustment of the fit of the helmet 10 using the adjustment mechanism 40. These inner pads constitute respective parts of the front portion 52, the left and right side portions 51, 53, the back portion 54, and the top portion 58 of the inner padding 15.

The inner padding 15 may be mounted to the outer shell 12 in various ways. For example, in some embodiments, the inner padding 15 may be mounted to the outer shell 12 by one or more fasteners such as mechanical fasteners (e.g., tacks, staples, rivets, screws, etc.), an adhesive, stitches, or any other suitable fastening element. In this embodiment in which the helmet 10 is adjustable, the inner padding 15 is affixed to the outer shell 12 such that, during movement of the front and rear outer shell members 22, 24 to adjust the size of the helmet 10, the pads of the inner padding 15 move along with the outer shell members 22, 24.

The inner padding 15 may be implemented in various other ways in other embodiments. For example, in other embodiments, the inner padding 15 may comprise a single monolithic pad facing the various regions of the player's head 11.

With additional reference to FIGS. 8 to 25, the visor system 42 comprises a visor 44 to protect at least part of the player's face 16 and a visor-supporting subsystem 46 to support the visor 44 on the left and right sides 32, 36 of the helmet 10.

The visor 44 is transparent to allow the player to see through the visor 44 and is configured to withstand impacts during play. The visor 44 thus constitutes a clear shield comprising a lens to protect at least part of the player's face 16 against impacts while the player is playing. Although the visor 44 is transparent, at least part of the visor 44 may be tinted in some embodiments.

The visor 44 may have any suitable size. In this embodiment, the visor 44 is dimensioned to cover an eye region of the player's face 16 to protect the player's eyes and to not cover a mouth region of the player's face 16. This may facilitate air circulation. The visor 44 may cover a smaller or greater extent of the player's face 16 (e.g., all of the player's face 16 including the mouth region) in other embodiments.

The visor 44 comprises an inner surface 45 facing the player's face 16, an outer surface 47 opposite the inner surface 45 and facing away from the player's face 16, a top edge 48, a bottom edge 50, and left and right ends 52, 54. The visor 44 also comprises a left connector 61 and a right connector 63 connectable to the visor-supporting subsystem 46.

In this embodiment, the visor 44 is curved such that its inner surface 45 is concave and its outer surface 47 is convex. In this example of implementation, at least a majority of, in this case an entirety of, the top edge 48 is generally straight when the top edge 48 is viewed in the longitudinal direction of the helmet 10 and in the transversal direction of the helmet 10, while the bottom edge 50 converges towards the top edge 48 when viewed in the transversal direction of the helmet 10. This straightness of the top edge 48 of the visor 44 may help for air circulation and be more aesthetic. For instance, in some examples of implementation, one or more standards, for instance, from the Canadian Standards Association (CSA), the American Society for Testing and Materials (ASTM), and/or the International Organization for Standardization (ISO), may require a coverage of the visor 44 to overlap the helmet by a certain extent (e.g., at least 6 mm) such that the straightness of the top edge 48 of the visor 44 may allow the top edge 48 of the visor 44 to meet this requirement while minimizing space occupied by the visor 44. The visor 44 may have any other suitable shape in other embodiments.

The visor 44 may comprise any suitable material. For example, in this embodiment, the visor 44 comprises polymeric material having suitable impact-resistance. More particularly, in this example of implementation, the polymeric material of the visor 44 is polycarbonate. The visor 44 may comprise any other suitable polymeric material and/or any other type of material in other examples of implementation (e.g., clear nylon, urethane-based material, polymethyl methacrylate, etc.).

The visor-supporting subsystem 46 may also comprise any suitable material. For example, in this embodiment, the visor-supporting subsystem 46 comprises polymeric material having suitable impact-resistance. More particularly, in this example of implementation, the polymeric material of the visor-supporting subsystem 46 is polycarbonate. The visor-supporting subsystem 46 may comprise any other suitable polymeric material and/or any other type of material in other examples of implementation (e.g., nylon, urethane-based material, polypropylene, polyethylene, etc.).

The visor system 42 is configured such that the helmet 10 is free of structure from the top edge 48 of the visor 44 to the outer shell 12 along at least a substantial part of the top edge 48 of the visor 44 when the visor-supporting subsystem 46 supports the visor 44 on the left and right sides 32, 36 of the helmet 10. In other words, the visor system 42 is configured such that no structure extends from the top edge 48 of the visor 44 to the outer shell 12 along at least a substantial part of the top edge 48 of the visor 44 when the visor-supporting subsystem 46 supports the visor 44 on the left and right sides 32, 36 of the helmet 10. Notably, in this embodiment, the visor system 42 is frameless (i.e., has no frame) along at least a substantial part of the top edge 48 of the visor 44. As such, in this embodiment, at least a substantial part of the top edge 48 of the visor 44 is exposed when the visor-supporting subsystem 46 supports the visor 44 on the left and right sides 32, 36 of the helmet 10. This absence of structure from the top edge 48 of the visor 44 to the outer shell 12 along at least a substantial part of the top edge 48 of the visor 44 renders the visor system 42 relatively lightweight and airy, which may help in terms of player vision and helmet ventilation.

More particularly, in this embodiment, the visor system 42 is configured such that the helmet 10 is free of structure from the top edge 48 of the visor 44 to the outer shell 12 along at least a majority of, in this case an entirety of, the top edge 48 of the visor 44 when the visor-supporting subsystem 46 supports the visor 44 on the left and right sides 32, 36 of the helmet 10. Notably, in this embodiment, the visor system 42 is frameless along at least a majority of, in this case an entirety of, the top edge 48 of the visor 44. As such, in this embodiment, at least a majority, in this case an entirety, of the top edge 48 of the visor 44 is exposed when the visor-supporting subsystem 46 supports the visor 44 on the left and right sides 32, 36 of the helmet 10.

The visor system 42 is configured to define an open gap 56 from the top edge 48 of the visor 44 to the outer shell 12 when the visor-supporting subsystem 46 supports the visor 44 on the left and right sides 32, 36 of the helmet 10. The open gap 56 facilitates ventilation of the helmet 10 and, in that sense, can be referred to as a "ventilation gap". In this embodiment, the open gap 56 extends along at least a majority of the top edge 48 of the visor 44. More particularly, in this example, the open gap 56 extends along at least three-quarters of, in this case an entirety of, the top edge 48 of the visor 44. In this example of implementation, given how the visor 44 is curved, the open gap 56 has a maximal dimension G generally at a widthwise center of the helmet 10 and decreases in size towards the left and right sides 32, 36 of the helmet 10. The open gap 56 may have any other shape in other examples of implementation.

In addition to facilitating ventilation, in some embodiments, the open gap 56 may also be beneficial for the player's vision. For example, the open gap 56 may make the visor system 42 less obstructive to the player's vision (e.g., when the player's head is down and his/her eyes are looking up), compared to if the visor system 42 had a frame or other structure in place of the open gap 56.

The visor-supporting subsystem 46 supports the visor 44 on the left and right sides 32, 36 of the helmet 10 when the visor 44 is connected to the visor-supporting subsystem 46. To that end, the visor-supporting subsystem 46 comprises a left visor support 66 for supporting the visor 44 on the left side 32 of the helmet 10 and a right visor support 68 for supporting the visor 44 on the right side 36 of the helmet 10.

The visor 44 is toollessly connectable to and toollessly disconnectable from the visor-supporting subsystem 46 to allow the player to toollessly connect the visor 44 to and toollessly disconnect the visor 44 from the visor-supporting subsystem 46. As used herein, "toollessly" means "manually without using any tool". In other words, the visor 44 is connectable to and disconnectable from the visor-supporting subsystem 46 manually without using any tool (e.g., a screwdriver or other tool) such that the player can connect the visor 44 to the visor-supporting subsystem 46 manually without using any tool and can disconnect the visor 44 from the visor-supporting subsystem 46 manually without using any tool. This makes mounting and removal of the visor 44 to and from a remainder of the helmet 10 rapid and convenient, which can be useful, for example, for visor replacement and/or for changing between use of the helmet 10 with the visor 44 and use of the helmet 10 without the visor 44.

More particularly, in this embodiment, the left connector 61 of the visor 44 is toollessly connectable to and toollessly disconnectable from the left visor support 66 and the right connector 63 of the visor 44 is toollessly connectable to and toollessly disconnectable from the right visor support 68 to allow the player to toollessly connect the visor 44 to the left visor support 66 and the right visor support 68 and toollessly disconnect the visor 44 from the left visor support 66 and the right visor support 68.

The visor 44 and the visor-supporting subsystem 46 may enable toolless connection and toolless disconnection of the visor 44 to and from the visor-supporting subsystem 46 in various ways.

For example, in this embodiment, the left visor support 66 comprises a visor-engaging connector 80 toollessly connectable to and toollessly disconnectable from the left connector 61 of the visor 44, while the right visor support 68 comprises a visor-engaging connector 81 toollessly connectable to and toollessly disconnectable from the right connector 63 of the visor 44. More particularly, in this example, the left connector 61 of the visor 44 is a male connector and the connector 80 of the left visor support 66 is a female connector configured to receive the male connector 61 of the visor 44. Similarly, in this example, the right connector 63 of the visor 44 is a male connector and the connector 81 of the left visor support 66 is a female connector configured to receive the male connector 63 of the visor 44. In other examples, each of the left connector 61 and the right connector 63 of the visor 44 may be a female connector, while each of the connector 80 of the left visor support 66 and the connector 81 of the right visor support 68 may be a male connector.

Also, in this embodiment, the left connector 61 of the visor 44 and the connector 80 of the left visor support 66 implement an actuator 83 that is manually operable by the player to disconnect them from one another when the player wants to detach the visor 44. In this case, the left connector 61 of the visor 44 comprises the actuator 83. Similarly, the right connector 63 of the visor 44 and the connector 81 of the left visor support 66 implement an actuator 84 that is manually operable by the player to disconnect them from one another when the player wants to detach the visor 44. In this case, the right connector 63 of the visor 44 comprises the actuator 83. In other embodiments, the actuator 83 and/or the actuator 84 may be part of the connector 80 of the left visor support 66 and/or the connector 81 of the right visor support 68.

More particularly, in this embodiment, the left connector 61 of the visor 44 and the left visor support 66 are configured to be clipped together to connect them together and the right connector 63 of the visor 44 and the right visor support 68 are configured to be clipped together to connect them together. Thus, in this example of implementation, the left connector 61 of the visor 44 and the left visor support 66 implement a left clip 71 for clipping the visor 44 on the left side 32 of the helmet 10 and the right connector 63 of the visor 44 and the right visor support 68 implement a right clip 73 for clipping the visor 44 on the right side 36 of the helmet 10.

In this example of implementation, the left clip 71 and the right clip 73 are configured similarly and so the left clip 71 will be described with an understanding that a similar description applies to the right clip 73.

In this embodiment, the left connector 61 of the visor 44 comprises a male clip portion 74 of the left clip 71 and the connector 80 of the left visor support 66 comprises a female clip portion 75 of the left clip 71 for receiving the male clip portion 74 to clip together the left connector 61 of the visor 44 and the left visor support 66. In this example, the male clip portion 74 comprises a tab 76 and the female clip portion 75 comprises an opening 77 to receive the tab 76. The tab 76 comprises the actuator 83, which in this case comprises a retention projection 78 that is movable relative to the opening 77 between an unlocked position, in which the tab 76 is able to move into and out of the opening 77, and a locked position, in which the tab 76 is locked into the opening 77 such that the male clip portion 74 and the female clip portion 57 are clipped together.

More particularly, in this example, when the tab 76 is inserted into the opening 77, the retention projection 78 is forced to move into its unlocked position to allow the tab 76 to move into the opening 77. Upon reaching a side window 79 of the opening 77, the retention projection 78 springs into the side window 79 and engages a border of the side window 79 such that it becomes fixed in its locked position. When the player wants to detach and remove the visor 44, he/she can press on the retention projection 78 via the side window 79, thereby causing the retention projection 78 to acquire its unlocked position to allow the tab 76 to be moved out of the opening 77. In this example, therefore, the actuator 83 serves as a push button that can be manually operated by the player to detach and remove the visor 44.

In this embodiment, the left clip 71 is configured to guide the visor 44 into the left visor support 66 when clipping the visor 44 to the left visor support 66 and is configured such that the left connector 61 of the visor 44 and the connector 80 of the left visor support 66 are interlocked to protect against unclipping of the visor 44 from the left visor support 66 upon an impact on the visor 44.

More particularly, in this embodiment, the left connector 61 of the visor 44 and the connector 80 of the left visor support 66 implement a guide 98 for guiding the visor 44 into the left visor support 66 when clipping the visor 44 to the left visor support 66. In this example, the guide 98 comprises upper and lower guiding projections $\mathbf{97}_1$, $\mathbf{97}_2$ of the left connector 61 of the visor 44 and upper and lower guiding recesses $\mathbf{96}_1$, $\mathbf{96}_2$ of the connector 80 of the left visor support 66 that receive the guiding projections $\mathbf{97}_1$, $\mathbf{97}_2$ when the visor 44 is clipped to the left visor support 66. In addition to guiding the visor 44 into the left visor support 66, in this case, the guiding projections $\mathbf{97}_1$, $\mathbf{97}_2$ are interlocked in the guiding recesses $\mathbf{96}_1$, $\mathbf{96}_2$ to oppose a tendency of the visor 44 to move relative to the left visor support 66 when the visor 44 is impacted.

Also, in this embodiment, the left connector 61 of the visor 44 and the connector 80 of the left visor support 66 implement a catch 99 for protecting against movement of the actuator 83 of the left connector 61 of the visor 44 relative to the side window 79 of the connector 80 of the left visor support 66 that could cause unclipping of the visor 44 from the left visor support 66. In this example, the catch 99 comprises a catch projection 38 of the actuator 83 of the left connector 61 of the visor 44 and a catch opening 39 of the connector 80 of the left visor support 66 to receive the catch projection 38. The catch 99 limits movement (e.g., rotation and/or transversal motion) of the actuator 83 relative to the left visor support 66 when the visor 44 is impacted.

The left clip 71 and the right clip 73 may be configured in various other ways in other embodiments to allow the visor 44 to be clipped to the visor-supporting subsystem 46 (e.g., each of the left connector 61 and the right connector 63 of the visor 44 may comprise a female clip portion, while each of the connector 80 of the left visor support 66 and the connector 81 of the right visor support 68 may comprise a male clip portion).

The visor 44 and the visor-supporting subsystem 46 may be toollessly connectable to and toollessly disconnectable from one another by quick-connect mechanisms other than clips in other embodiments (e.g., manually-screwable screws requiring no tools for screwing them, magnets, etc.).

In this embodiment, the left visor support 66 and the right visor support 68 are separate from one another and fastenable to the outer shell 12. That is, the left visor support 66 and the right visor support 68 are distinct and separable from one another and can be individually fastened to the outer shell 12. This may allow the visor system 42 to be mountable to various helmet models (e.g., models having different widthwise dimensions).

Therefore, in this example of implementation, the visor system 42 is connected to the outer shell 12 only at the left visor support 66 and the right visor support 68. The visor system 42 is unconnected (i.e., unattached) to the outer shell 12 between the left visor support 66 and the right visor support 68. Notably, the left visor support 66 and the right visor support 68 are unconnected across the top edge 48 of the visor 44. This absence of a frame interconnecting the left visor support 66 and the right visor support 68 and extending between the top edge 48 of the visor 44 and the outer shell 12 results in the visor system 42 being frameless along the top edge 48 of the visor 44, as discussed previously. The visor system 42 is nevertheless configured to meet a certification standard to protect the player upon the visor 44 being impacted (e.g., such that the visor 44 does not dislodge from the left visor support 66 and the right visor support 68 upon impact). For example, in some embodiments, the visor system 42 may meet one or more of the CSA Z262.2-09 standard of the Canadian Standards Association (CSA), the ASTM F513-12 of the American Society for Testing and Materials (ASTM), and the ISO 10256-07 standard of the International Organization for Standardization (ISO).

Also, in this embodiment, the left visor support 66 and the right visor support 68 are configured such that a position of the visor 44 relative to the outer shell 12 is adjustable. In this example of implementation, the position of the visor 44 relative to the outer shell 12 is adjustable in the longitudinal direction of the helmet 10 and in the height direction of the helmet 10. Other adjustments are possible in other examples of implementation (e.g., only in the longitudinal direction of the helmet 10 or only in the height direction of the helmet 10). This adjustability of the position of the visor 44 relative to the outer shell 12 may allow the player to adjust the visor 44 as he/she desires and may also promote compatibility of the visor system 42 with various helmet models.

In this example of implementation, the left visor support 66 and the right visor support 68 are configured similarly and so the left visor support 66 will be described with an understanding that a similar description applies to the right visor support 68.

In this embodiment, the left visor support 66 comprises a base 85 fastenable to the outer shell 12. One or more fasteners (e.g., screws, bolts or other threaded fasteners) may be used to fasten the base 85 to the outer shell 12. For instance, in this embodiment, the base 85 comprises a plurality of holes $\mathbf{86}_1$, $\mathbf{86}_2$ to receive fasteners $\mathbf{87}_1$, $\mathbf{87}_2$ fastening the base 85 to the outer shell 12. In this example, each of the holes $\mathbf{86}_1$, $\mathbf{86}_2$ is a slot which is elongated to allow adjustment of a position of the base 85 relative to the outer shell 12. In this case, each of the slots $\mathbf{86}_1$, $\mathbf{86}_2$ is elongated in the height direction of the helmet 10 to allow the position of the base 85 relative to the outer shell 12 to be adjusted in the height direction.

Furthermore, in this embodiment, the connector 80 of the left visor support 66 is fastenable to the base 85 of the left visor support 66. One or more fasteners (e.g., screws, bolts or other threaded fasteners) may be used to fasten the connector 80 to the base 85. For instance, in this embodiment, the base 85 comprises a hole 88 and the connector 80 comprises a hole 89 to receive a fastener 90 fastening the connector 80 to the base 85. In this example, the hole 89 of the connector 80 is a slot which is elongated to allow adjustment of a position of the connector 80 relative to the base 85. In this case, the slot 89 is elongated in the longitudinal direction of the helmet 10 to allow the position of the connector 80 relative to the base 85 to be adjusted in the longitudinal direction.

In addition, in this embodiment, the base 85 and the connector 80 of the left visor support 66 are interlocked when the connector 80 is fastened to the base 85 to protect against movement of the connector 80 relative to the base 85 upon an impact on the visor 44. For example, in this case, the base 85 and the connector 80 are interlocked to oppose a tendency of the connector 80 to rotate and/or move backwards relative to the base 85 when the visor 44 is impacted.

More particularly, in this embodiment, the base 85 of the left visor support 66 comprises an interlocking structure 91 and the connector 80 of the left visor support 66 comprises an interlocking structure 92 which interlocks with the interlocking structure 91 of the base 85 when the connector 80 is fastened to the base 85. In this example of implementation, the interlocking structure 91 of the base 85 comprises a plurality of interlocking projections $\mathbf{92}_1$-$\mathbf{92}_9$ spaced apart in the longitudinal direction of the helmet 10 by a plurality of interlocking recesses $\mathbf{93}_1$-$\mathbf{93}_8$, while the interlocking structure 92 of the connector 80 comprises a plurality of interlocking projections $\mathbf{94}_1$-$\mathbf{94}_{10}$ spaced apart in the longitudinal direction of the helmet 10 by a plurality of interlocking recesses $\mathbf{95}_1$-$\mathbf{95}_9$. When they are fastened together, the connector 80 and the base 85 are interlocked by virtue of respective ones of the interlocking projections $\mathbf{92}_1$-$\mathbf{92}_9$ of the base 85 which are received in respective ones of the interlocking recesses $\mathbf{95}_1$-$\mathbf{95}_9$ of the connector 80 and respective ones of the interlocking projections $\mathbf{94}_1$-$\mathbf{94}_{10}$ of the connector 80 which are received in respective ones of the interlocking recesses $\mathbf{93}_1$-$\mathbf{93}_8$ of the base 85. In this case, each of the interlocking projections $\mathbf{92}_1$-$\mathbf{92}_9$, $\mathbf{94}_1$-$\mathbf{94}_{10}$ and each of the interlocking recesses $\mathbf{93}_1$-$\mathbf{93}_8$, $\mathbf{95}_1$-$\mathbf{95}_9$ is elongated. The interlocking projections $\mathbf{92}_1$-$\mathbf{92}_9$, $\mathbf{94}_1$-$\mathbf{94}_{10}$ and the interlocking recesses $\mathbf{93}_1$-$\mathbf{93}_8$, $\mathbf{95}_1$-$\mathbf{95}_9$ may have various other shapes in other cases.

The interlocking structure 91 of the base 85 and the interlocking structure 92 of the connector 80 may be configured in various other ways in other embodiments to protect against movement of the connector 80 relative to the base 85 upon an impact on the visor 44 (e.g., a screw creating an interlocking engagement, a pin interlocking in a hole, etc.).

Any feature of any embodiment discussed herein may be combined with any feature of any other embodiment discussed herein in some examples of implementation.

While in embodiments considered above the helmet 10 is a hockey helmet for protecting the head of a hockey player, in other embodiments, a protective sport helmet constructed using principles described herein in respect of the helmet 10 may be another type of protective sport helmet. For instance, a protective sport helmet constructed using principles described herein in respect of the helmet 10 may be for protecting the head of a player of another type of contact sport (sometimes referred to as "full-contact sport" or "collision sport") in which there are significant impact forces on the player due to player-to-player and/or player-to-object contact. For example, in one embodiment, a protective sport helmet constructed using principles described herein in respect of the helmet 10 may be a lacrosse helmet for protecting the head of a lacrosse player. As another example, in one embodiment, a protective sport helmet constructed using principles described herein in respect of the helmet 10 may be a football helmet for protecting the head of a football player. Furthermore, a protective sport helmet constructed using principles described herein in respect of the helmet 10 may be for protecting the head of a user involved in a sport other than a contact sport (e.g., bicycling, skiing, snowboarding, etc.).

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A visor system for a protective sport helmet configured to be worn on a head of a user, the protective sport helmet comprising a front configured for facing a front region of the head, a back configured for facing a back region of the head, a left side configured for facing a left side region of the head, and a right side configured for facing a right side region of the head, the protective sport helmet comprising an outer shell and inner padding disposed within the outer shell, the visor system comprising:

a) a visor configured for protecting at least part of a face of the user, the visor being transparent to allow the user to see through the visor, the visor comprising an inner surface configured for facing the user's face, an outer surface opposite the inner surface and configured for facing away from the user's face, a top edge, a bottom edge, a left connector, and a right connector;

b) a left visor support for connecting the visor on the left side of the protective sport helmet, the left visor support being fastenable to the outer shell on the left side of the protective sport helmet; and c) a right visor support for connecting the visor on the right side of the protective sport helmet, the right visor support being fastenable to the outer shell on the right side of the protective sport helmet, and the right visor support and the left visor support being separate from one another;

wherein the left connector of the visor is toollessly connectable to and toollessly disconnectable from the left visor support and the right connector of the visor is toollessly connectable to and toollessly disconnectable from the right visor support to allow the user to toollessly connect the visor to the left visor support and the right visor support and toollessly disconnect the visor from the left visor support and the right visor support; and wherein the visor system is configured to define an open gap forward of the outer shell from the top edge of the visor to the outer shell when the left visor support and the right visor support are connecting the visor on the left side of the protective sport helmet and the right side of the protective sport helmet.

2. The visor system of claim 1, wherein the open gap extends along at least a majority of the top edge of the visor.

3. The visor system of claim 1, wherein the open gap extends along at least three-quarters of the top edge of the visor.

4. The visor system of claim 1, wherein at least a majority of the top edge of the visor is exposed when the left visor support and the right visor support are connecting the visor on the left side of the protective sport helmet and the right side of the protective sport helmet.

5. The visor system of claim 1, wherein an entirety of the top edge of the visor is exposed when the left visor support and the right visor support are connecting the visor on the left side of the protective sport helmet and the right side of the protective sport helmet.

6. The visor system of claim 1, wherein at least a majority of the top edge of the visor is substantially straight when the top edge of the visor is viewed in a longitudinal direction of the protective sport helmet and in a transversal direction of the protective sport helmet.

7. The visor system of claim 1, wherein an entirety of the top edge of the visor is substantially straight when the top edge of the visor is viewed in a longitudinal direction of the protective sport helmet and in a transversal direction of the protective sport helmet.

8. The visor system of claim 1, wherein the left connector of the visor and the left visor support implement a left actuator manually operable by the user to disconnect them from one another when the user wants to detach the visor and the right connector of the visor and the right visor support implement a right actuator manually operable by the user to disconnect them from one another when the user wants to detach the visor.

9. The visor system of claim 1, wherein the left connector of the visor and the left visor support are configured to be clipped together and the right connector of the visor and the right visor support are configured to be clipped together.

10. The visor system of claim 1, wherein the left connector of the visor and the left visor support implement a left clip for clipping the visor on the left side of the protective sport helmet and the right connector of the visor and the right visor support implement a right clip for clipping the visor on the right side of the protective sport helmet.

11. The visor system of claim 1, wherein: the left visor support comprises a visor-engaging connector toollessly connectable to and toollessly disconnectable from the left connector of the visor; the right visor support comprises a visor-engaging connector toollessly connectable to and toollessly disconnectable from the right connector of the visor; a given one of the left connector of the visor and the visor-engaging connector of the left visor support is a left male connector and the other one of the left connector of the visor and the visor-engaging connector of the left visor support is a left female connector; and a given one of the right connector of the visor and the visor-engaging connector of the right visor support is a right male connector and the other one of the right connector of the visor and the visor-engaging connector of the right visor support is a right female connector.

12. The visor system of claim 8, wherein the left connector of the visor comprises the left actuator and the right connector of the visor comprises the right actuator.

13. The visor system of claim 12, wherein each of the left actuator and the right actuator is manually operable as a push button.

14. The visor system of claim 1, wherein the left visor support and the right visor support are configured such that a position of the visor relative to the outer shell is adjustable.

15. The visor system of claim 14, wherein the position of the visor relative to the outer shell is adjustable in a longitudinal direction of the protective sport helmet.

16. The visor system of claim 15, wherein the position of the visor relative to the outer shell is adjustable in a height direction of the protective sport helmet.

17. The visor system of claim 1, wherein each of the left visor support and the right visor support further comprises a base fastenable to the outer shell and a visor-engaging connector fastenable to the base and toollessly connectable to and toollessly disconnectable from a corresponding one of the left connector of the visor and the right connector of the visor.

18. The visor system of claim 17, wherein the base and the visor-engaging connector are configured such that a position of the visor-engaging connector relative to the base is adjustable.

19. The visor system of claim 18, wherein the position of the visor-engaging connector relative to the base is adjustable in a longitudinal direction of the protective sport helmet.

20. The visor system of claim 18, wherein the visor-engaging connector comprises a slot for receiving a fastener fastening the visor-engaging connector to the base, the slot being elongated to allow adjustment of the position of the visor-engaging connector relative to the base.

21. The visor system of claim 17, wherein the base is configured such that a position of the base relative to the outer shell is adjustable.

22. The visor system of claim 21, wherein the position of the base relative to the outer shell is adjustable in a height direction of the protective sport helmet.

23. The visor system of claim 21, wherein the base comprises a slot for receiving a fastener fastening the base to the outer shell, the slot being elongated to allow adjustment of the position of the base relative to the outer shell.

24. The visor system of claim 17, wherein the base and the visor-engaging connector are interlocked when the visor-engaging connector is fastened to the base to protect against movement of the visor-engaging connector relative to the base upon an impact on the visor.

25. The visor system of claim 17, wherein the base comprises an interlocking structure and the visor-engaging connector comprises an interlocking structure which interlocks with the interlocking structure of the base when the visor-engaging connector is fastened to the base.

26. The visor system of claim 25, wherein a given one of the interlocking structure of the base and the interlocking structure of the visor-engaging connector comprises a plurality of interlocking projections and the other one of the interlocking structure of the base and the interlocking structure of the visor-engaging connector comprises a plurality of interlocking recesses receiving respective ones of the interlocking projections.

27. The visor system of claim 26, wherein the interlocking projections and the interlocking recesses are spaced apart in a longitudinal direction of the protective sport helmet.

28. The visor system of claim 26, wherein each of the interlocking projections and each of the interlocking recesses is elongated.

29. A protective sport helmet comprising the visor system of claim 1.

* * * * *